US011043184B2

(12) United States Patent
An et al.

(10) Patent No.: US 11,043,184 B2
(45) Date of Patent: Jun. 22, 2021

(54) DISPLAY DEVICE SUPPORTING VARIABLE FRAME MODE, AND METHOD OF OPERATING DISPLAY DEVICE

(71) Applicant: Samsung Display Co., Ltd., Yongin-si (KR)

(72) Inventors: Taehyeong An, Hwaseong-si (KR); Jai-Hyun Koh, Yongin-si (KR); Hoi Sik Moon, Hwaseong-si (KR); Jae Sung Bae, Suwon-si (KR); Namjae Lim, Gwacheon-si (KR); Nam-Gon Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 149 days.

(21) Appl. No.: 16/523,479

(22) Filed: Jul. 26, 2019

(65) Prior Publication Data

US 2020/0082781 A1 Mar. 12, 2020

(30) Foreign Application Priority Data

Sep. 7, 2018 (KR) ..... 10-2018-0107341

(51) Int. Cl.
*G09G 5/00* (2006.01)

(52) U.S. Cl.
CPC ..... *G09G 5/003* (2013.01); *G09G 2320/0673* (2013.01)

(58) Field of Classification Search
CPC ..... G09G 5/003; G09G 2320/0673
See application file for complete search history.

(56) References Cited

U.S. PATENT DOCUMENTS

| | | | | |
|---|---|---|---|---|
| 10,147,370 | B2 * | 12/2018 | Verbeure | G09G 3/3611 |
| 10,565,953 | B2 * | 2/2020 | Kim | G09G 3/3696 |
| 10,832,624 | B2 * | 11/2020 | Ahn | G09G 3/3614 |
| 2014/0071106 | A1 * | 3/2014 | Lin | G09G 3/3688 345/211 |
| 2016/0063914 | A1 * | 3/2016 | Lee | G09G 3/3648 345/211 |
| 2018/0122327 | A1 * | 5/2018 | Kim | G09G 3/3688 |

FOREIGN PATENT DOCUMENTS

| | | | |
|---|---|---|---|
| KR | 10-1651291 | B1 | 8/2016 |
| KR | 10-2017-0028479 | A | 3/2017 |
| KR | 10-2018-0049332 | A | 5/2018 |

* cited by examiner

*Primary Examiner* — Gene W Lee
(74) *Attorney, Agent, or Firm* — Lewis Roca Rothgerber Christie LLP

(57) ABSTRACT

A display device includes a display panel comprising a plurality of pixels, a data driver configured to generate data voltages based on a gamma reference voltage, and to provide the data voltages to the plurality of pixels, a gate driver configured to provide gate signals to the plurality of pixels, and a controller configured to control the data driver and the gate driver. The controller is configured to initialize the gamma reference voltage when a blank period starts in a frame period comprising an active period and the blank period, and to change the gamma reference voltage when a duration of the blank period reaches at least one threshold time.

20 Claims, 8 Drawing Sheets

DISPLAY DEVICE SUPPORTING VARIABLE FRAME MODE, AND METHOD OF OPERATING DISPLAY DEVICE

CROSS-REFERENCE TO RELATED APPLICATION(S)

This application claims priority to and the benefit of Korean Patent Application No. 10-2018-0107341, filed on Sep. 7, 2018 in the Korean Intellectual Property Office (KIPO), the content of which is incorporated herein in its entirety by reference.

BACKGROUND

1. Field

An embodiment of the present invention relates to display devices, and more particularly to display devices supporting variable frame modes, and methods of operating the display devices.

2. Description of the Related Art

A display device may generally display (or refresh) an image with (or at) a constant frame rate of about 60 Hz or more. However, a frame rate of rendering by a host processor (e.g., a graphic processing unit (GPU) or a graphic card) providing frame data to the display device may be different from the refresh frame rate of the display device. In particular, when the host processor provides the display device with frame data for a game image (gaming image) that requires complicated rendering, the frame rate mismatch may be intensified, and a tearing phenomenon where a boundary line is caused by the frame rate mismatch in an image of the display device may occur.

To prevent or reduce the tearing phenomenon, a variable frame mode (e.g., Free-Sync, G-Sync, etc.) in which a host processor provides frame data to a display device with a variable frame rate by changing a time length of a blank period in each frame has been developed. A display device supporting the variable frame mode may display (or refresh) an image in synchronization with the variable frame rate, thereby reducing or preventing the tearing phenomenon.

However, in the display device operating in the variable frame mode, the time length (or a duration of time) of the blank period may be increased compared with a time length of a blank period in a normal mode in which an image is displayed with a constant frame rate, and the increased blank period may cause a leakage current, etc., which results in deterioration of luminance and deterioration of an image quality.

SUMMARY

Aspects of some example embodiments are directed toward a display device capable of improving an image quality in a variable frame mode.

Aspects of some example embodiments are directed toward a method of operating a display device capable of improving an image quality in a variable frame mode.

According to example embodiments, there is provided a display device including a display panel including a plurality of pixels, a data driver configured to generate data voltages based on a gamma reference voltage, and to provide the data voltages to the plurality of pixels, a gate driver configured to provide gate signals to the plurality of pixels, and a controller configured to control the data driver and the gate driver. The controller may initialize the gamma reference voltage when a blank period starts in a frame period including an active period and the blank period, and to change the gamma reference voltage when duration of the blank period reaches at least one threshold time.

In example embodiments, the active period may have a constant time length, and the blank period may have a variable time length.

In example embodiments, the controller may initialize the gamma reference voltage at a start time point of the blank period of the frame period.

In example embodiments, the controller may initialize the gamma reference voltage before the at least one threshold time from a start time point of the blank period of the frame period.

In example embodiments, the controller may initialize the gamma reference voltage at a voltage level corresponding to a maximum frame rate in a variable frame rate range supported by the display device.

In example embodiments, when the duration of the blank period reaches the at least one threshold time, the controller may change the gamma reference voltage from a first voltage level corresponding to a first frame rate to a second voltage level corresponding to a second frame rate lower than the first frame rate.

In example embodiments, an absolute value of the second voltage level may be greater than an absolute value of the first voltage level.

In example embodiments, the at least one threshold time may include a first threshold time and a second threshold time greater than the first threshold time. When the duration of the blank period reaches the first threshold time, the controller may change the gamma reference voltage from a first voltage level to a second voltage level having an absolute value greater than that of the first voltage level. When the duration of the blank period reaches the second threshold time, the controller may change the gamma reference voltage from the second voltage level to a third voltage level having an absolute value greater than that of the second voltage level.

In example embodiments, the display device may further include a power management circuit configured to generate the gamma reference voltage. When the blank period starts, the controller may control the power management circuit to initialize the gamma reference voltage to a first voltage level by providing a voltage control signal indicating the first voltage level to the power management circuit. When the duration of the blank period reaches the at least one threshold time, the controller may control the power management circuit to change the gamma reference voltage from the first voltage level to a second voltage level by providing the voltage control signal indicating the second voltage level having an absolute value greater than that of the first voltage level to the power management circuit.

In example embodiments, the controller may include an active time counter configured to generate an active count signal by counting an input clock signal during the active period, a first comparator configured to compare the active count signal with a first reference signal corresponding to a multiplication of a number of horizontal lines by a number of vertical lines, a blank time counter configured to generate a blank count signal by counting the input clock signal during the blank period, at least one second comparator configured to compare the blank count signal with at least one second reference signal corresponding to the at least one threshold time, and a voltage controller configured to transfer a voltage control signal indicating a first voltage level to a power management circuit included in the display device when the active count signal becomes greater than or equal to the first reference signal, and to transfer the voltage control signal indicating a second voltage level having an absolute value greater than that of the first voltage level to the power management circuit when the blank count signal becomes greater than or equal to the second reference signal.

In example embodiments, the voltage controller may reset the active time counter and the blank time counter when a data enable signal toggles before the blank count signal becomes greater than or equal to the second reference signal.

In example embodiments, the controller may include the at least one second comparator including a plurality of second comparators configured to compare the blank count signal with a plurality of second reference signals respectively corresponding to a plurality of different threshold times.

In example embodiments, the voltage controller may transfer the voltage control signal to the power management circuit through an inter-integrated circuit (I2C) interface.

According to example embodiments, there is provided a method of operating a display device. In the method, a gamma reference voltage is initialized when a blank period starts in a frame period including an active period and the blank period, the gamma reference voltage is changed when duration of the blank period reaches at least one threshold time, and an image is displayed based on the gamma reference voltage.

In example embodiments, to initialize the gamma reference voltage when the blank period starts, the gamma reference voltage may be initialized to a voltage level corresponding to a maximum frame rate in a variable frame rate range supported by the display device at a start time point of the blank period of the frame period.

In example embodiments, to change the gamma reference voltage when the duration of the blank period reaches the at least one threshold time, the gamma reference voltage may be changed from a first voltage level corresponding to a first frame rate to a second voltage level corresponding to a second frame rate lower than the first frame rate when the duration of the blank period reaches the at least one threshold time.

In example embodiments, the at least one threshold time may include a first threshold time and a second threshold time greater than the first threshold time. To change the gamma reference voltage when the duration of the blank period reaches the at least one threshold time, the gamma reference voltage may be changed from a first voltage level to a second voltage level having an absolute value greater than that of the first voltage level when the duration of the blank period reaches the first threshold time, and the gamma reference voltage may be changed from the second voltage level to a third voltage level having an absolute value greater than that of the second voltage level when the duration of the blank period reaches the second threshold time.

In example embodiments, to initialize the gamma reference voltage when the blank period starts, an active count signal may be generated by counting an input clock signal during the active period, the active count signal may be compared with a first reference signal corresponding to a multiplication of a number of horizontal lines by a number of vertical lines, and the gamma reference voltage may be initialized when the active count signal becomes greater than or equal to the first reference signal.

In example embodiments, to change the gamma reference voltage when the duration of the blank period reaches the at least one threshold time, a blank count signal may be generated by counting the input clock signal during the blank period, the blank count signal may be compared with at least one second reference signal corresponding to the at least one threshold time, and the gamma reference voltage may be changed when the blank count signal becomes greater than or equal to the second reference signal.

In example embodiments, the active count signal and the blank count signal may be initialized when a data enable signal toggles before the blank count signal becomes greater than or equal to the second reference signal.

As described above, the display device and the method of operating the display device according to example embodiments may initialize a gamma reference voltage if a blank period starts in each frame period, and may change the gamma reference voltage when duration of the blank period reaches at least one threshold time. Accordingly, deterioration of luminance caused by an increase in time of a variable blank period in a variable frame mode may be reduced or prevented. Further, when a frame rate is changed, the gamma reference voltage is changed to a voltage level corresponding to the changed frame rate in (a blank period of) the same frame period at which the frame rate is changed, and thus a frame latency between a frame rate change and a gamma reference voltage change may be reduced.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
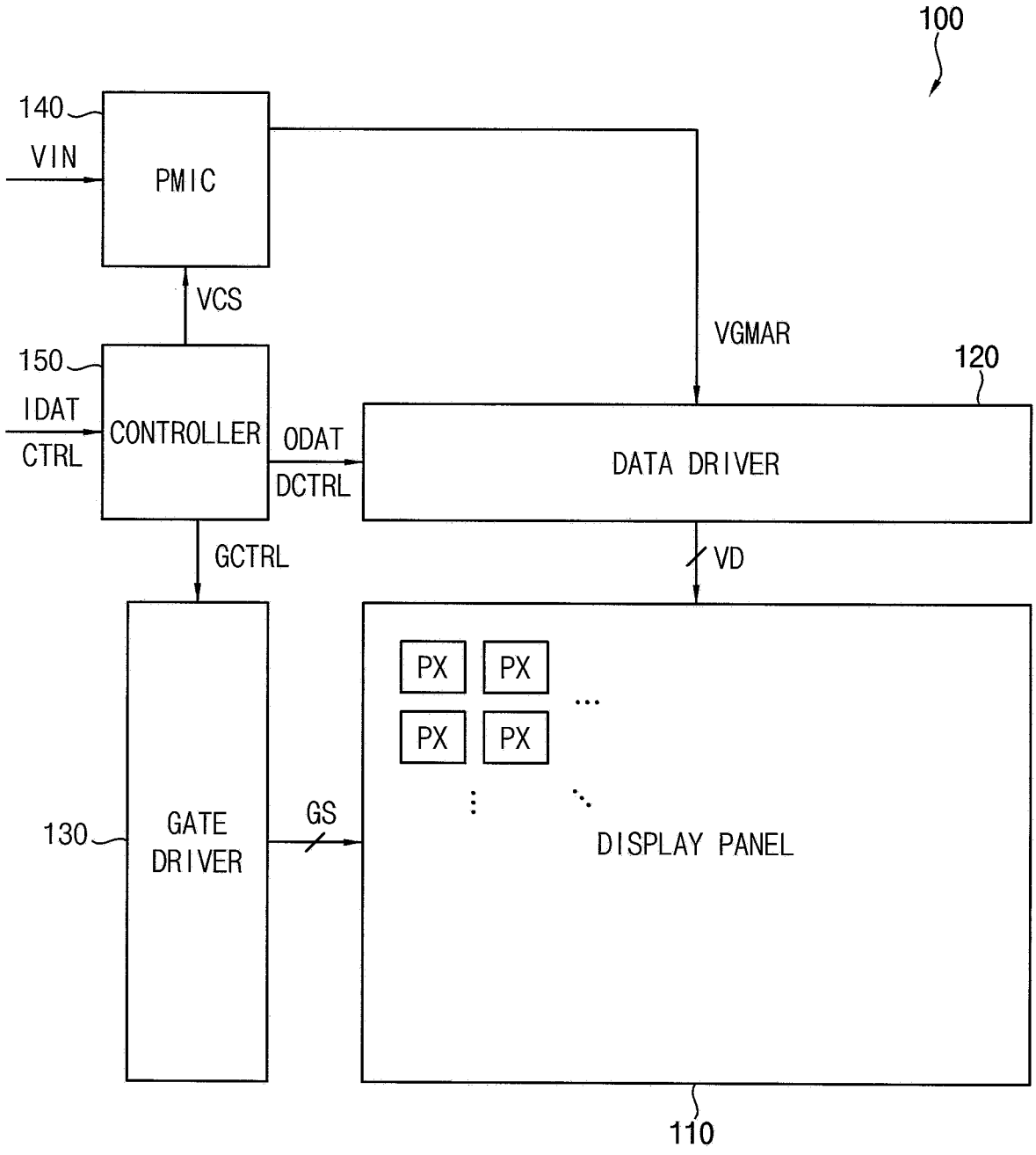
FIG. 1 is a block diagram illustrating a display device according to example embodiments.

Hereinafter, embodiments of the present inventive concept will be explained in detail with reference to the accompanying drawings.

It will be understood that, although the terms "first," "second," "third," etc., may be used herein to describe various elements, components, levels, signals and/or thresholds, these elements, components, levels, signals and/or thresholds should not be limited by these terms. These terms are used to distinguish one element, component, level, signal or threshold from another element, component, level, signal or threshold. Thus, a first element, component, region, layer or section described below could be termed a second element, component, region, layer or section, without departing from the spirit and scope of the present disclosure.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

It will be understood that when an element or layer is referred to as being "coupled to" another element or layer, it can be directly coupled to the other element or layer, or one or more intervening elements or layers may be present. In contrast, when an element or layer is referred to as being "directly coupled to" another element or layer, there are no intervening elements or layers present.

As used herein, the term "about," and similar terms are used as terms of approximation and not as terms of degree, and are intended to account for the inherent deviations in measured or calculated values that would be recognized by those of ordinary skill in the art. Further, the use of "may" when describing embodiments of the present disclosure refers to "one or more embodiments of the present disclosure."

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

The electronic or electric devices and/or any other relevant devices or components according to embodiments of the present disclosure described herein, such as, for example, an external controller, a timing controller, power management circuit, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
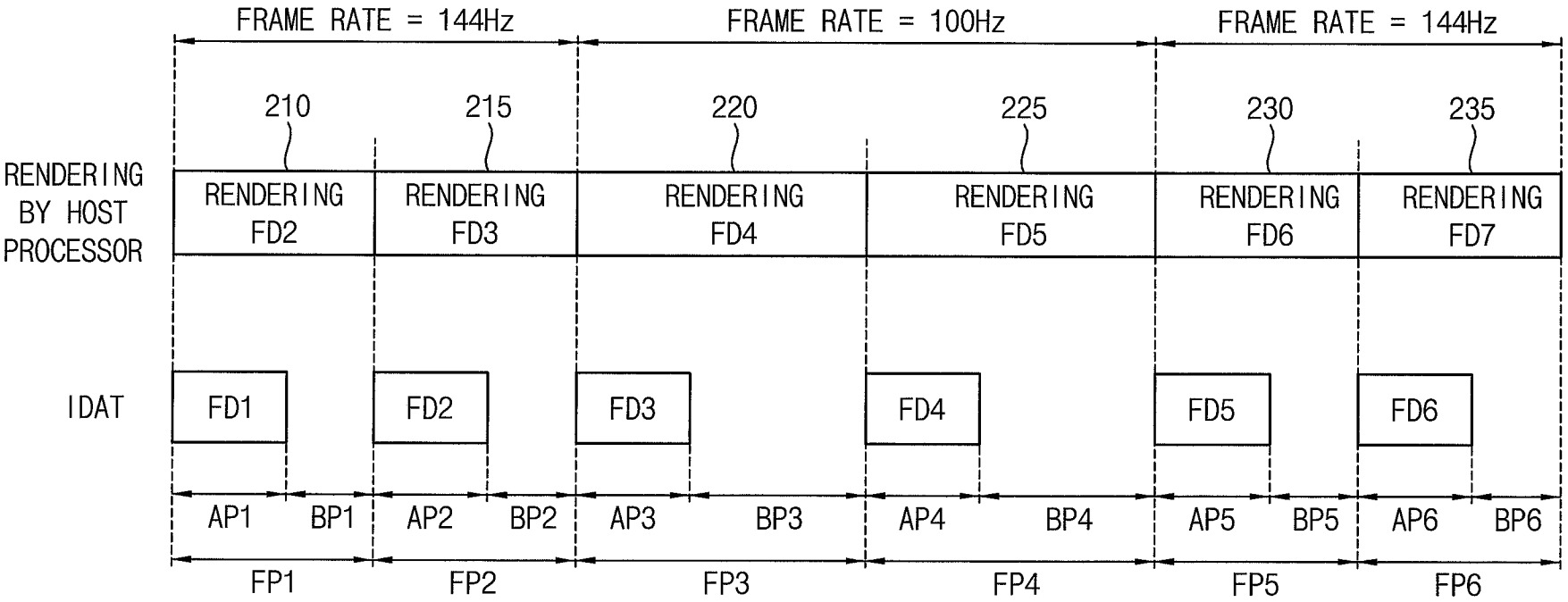
FIG. 2 is a diagram illustrating an example of frame data inputted to a display device in a variable frame mode.

FIG. 1 is a block diagram illustrating a display device according to example embodiments, and FIG. 2 is a diagram illustrating an example of frame data inputted to a display device in a variable frame mode.

Referring to FIG. 1, a display device 100 may include a display panel 110 which may include a plurality of pixels PX, a data driver 120 which may provide data voltages VD to the plurality of pixels PX, a gate driver 130 which may provide gate signals GS to the plurality of pixels PX, a power management circuit 140 which may generate a gamma reference voltage VGMAR, and a controller 150 (e.g., a controller circuit) which may control the data driver 120, the gate driver 130, and the power management circuit 140.

The display panel 110 may include a plurality of data lines, a plurality of gate lines, and a plurality of pixels PX. The plurality of pixels PX may be coupled to the plurality of data lines and the plurality of gate lines. In some example embodiments, each pixel of the plurality of pixels PX may include a switching transistor and a liquid crystal capacitor coupled to the switching transistor. The display panel 110 may be a liquid crystal display (LCD) panel. However, the display panel 110 may not be limited to an LCD panel, and may be any suitable display panel.

The data driver 120 may generate the data voltages VD based on image data ODAT and a data control signal DCTRL output from the controller 150, and may provide the data voltages VD to the plurality of pixels PX. For example, the data control signal DCTRL may include, but not be limited to, an output data enable signal, a horizontal start signal, and a load signal. In some example embodiments, the data driver 120 may be implemented with one or more data integrated circuits (ICs). Further, according to some example embodiments, the data driver 120 may be mounted directly on the display panel 110, or may be coupled to the display panel 110 in a form of a tape carrier package (TCP). In other example embodiments, the data driver 120 may be integrated in a peripheral portion of the display panel 110.

The gate driver 130 may generate the gate signals GS based on a gate control signal GCTRL from the controller 150, and may provide the gate signals GS to the plurality of pixels PX. In some example embodiments, the gate control signal GCTRL may include, but not be limited to, a frame start signal (STV in FIG. 4) and a gate clock signal. In some example embodiments, the gate driver 130 may be implemented as an amorphous silicon gate (ASG) driver integrated in the peripheral portion of the display panel 110. In other example embodiments, the gate driver 130 may be implemented with one or more gate ICs. Further, according to some example embodiments, the gate driver 130 may be mounted directly on the display panel 110, or may be coupled to the display panel 110 in the form of the TCP.

The power management circuit 140 may generate a gamma reference voltage VGMAR which may be provided to the data driver 120. For example, the power management circuit 140 may receive an input voltage VIN from an external power source, may generate the gamma reference voltage VGMAR based on the input voltage VIN, and may provide the gamma reference voltage VGMAR to the data driver 120. The data driver 120 may generate the data voltages VD based on the gamma reference voltage VGMAR provided by the power management circuit 140. For example, the data driver 120 may generate gray voltages (e.g., 256 gray voltages) respectively corresponding to the entire gray levels (e.g., from 0-gray level to 255-gray level) based on the gamma reference voltage VGMAR. The data driver 120 may provide data voltages VD to the plurality of pixels PX based on the gray voltages corresponding to gray level indicated by the image data ODAT output from the controller 150. In some example embodiments, the gamma reference voltage VGMAR may include a positive gamma reference voltage and a negative gamma reference voltage. In these example embodiments, the data driver 120 may provide positive data voltages VD to the plurality of pixels PX based on the positive gamma reference voltage, and may provide negative data voltages VD to the plurality of pixels PX based on the negative gamma reference voltage. In some example embodiments, the power management circuit 140 may further generate, based on the input voltage VIN, an analog driving voltage provided to the data driver 120 and/or the controller 150, a gate driving voltage (e.g., a high gate voltage and a low gate voltage) provided to the gate driver 130, etc. Further, in some example embodiments, the power management circuit 140 may be implemented as a power management integrated circuit (PMIC) where the power management circuit 140 and controller 150 may be on the same control board.

The controller (e.g., a timing controller; TCON) 150 may receive input image data IDAT and a control signal CTRL from an external host processor (e.g., a graphic processing unit (GPU) or a graphic card). In some example embodiments, the input image data IDAT may be RGB data including red image data, green image data and blue image data. In some example embodiments, the control signal CTRL may include, but not be limited to, a vertical synchronization signal, a horizontal synchronization signal, an input data enable signal, a master clock signal, etc. The controller 150 may generate the gate control signal GCTRL, the data control signal DCTRL, and the output image data ODAT based on the control signal CTRL and the input image data IDAT. The controller 150 may control an operation of the data driver 120 by providing the data control signal DCTRL and the output image data ODAT to the data driver 120, and may control an operation of the gate driver 130 by providing the gate control signal GCTRL to the gate driver 130.

The controller 150 according to example embodiments may support a variable frame mode in which the host processor provides the input image data IDAT to the display device 100 with a variable frame rate by changing a time length (or a duration of time) of a blank period in each frame period and the controller 150 provides the output image data ODAT to the data driver 120 in synchronization with the variable frame rate such that an image is displayed (or refreshed) with the variable frame rate. For example, the variable frame mode may include a Free-Sync mode, a G-Sync mode, etc.

For example, as illustrated in FIG. 2, a period of each of renderings 210, 215, 220, 225, 230 and 235 by the host processor (e.g., the GPU or the graphic card) may not be constant (in particular, in a case where game image data are rendered), and the host processor may provide the input image data IDAT, or frame data FD1, FD2, FD3, FD4, FD5 and FD6 to the display device 100 in synchronization with, respectively, these irregular periods of renderings 210, 215, 220, 225, 230 and 235 in the variable frame mode. Thus, in the variable frame mode, each frame period FP1, FP2, FP3, FP4, FP5 and FP6 may include a constant active period AP1, AP2, AP3, AP4, AP5 and AP6 having a constant time length, and the host processor may provide the frame data FD1, FD2, FD3, FD4, FD5 and FD6 to the display device 100 with a variable frame rate by changing a time length of a blank period BP1, BP2, BP3, BP4, BP5 and BP6 of the frame period FP1, FP2, FP3, FP4, FP5 and FP6.

In an example of FIG. 2, if renderings 210 and 215 for second and third frame data FD2 and FD3 are performed with a frequency of about 144 Hz in first and second frame periods FP1 and FP2, the host processor may provide first and second frame data FD1 and FD2 to the display device 100 with a frame rate of about 144 Hz in the first and second frame periods FP1 and FP2. Further, the host processor may output the third frame data FD3 during an active period AP3 of a third frame period FP3, may continue a blank period BP3 of the third frame period FP3 until rendering 220 for fourth frame data FD4 is completed, may output the fourth frame data FD4 during an active period AP4 of a fourth frame period FP4, and may continue a blank period BP4 of the fourth frame period FP4 until rendering 225 for fifth frame data FD5 is completed. Thus, in the third and fourth frame periods FP3 and FP4, if the renderings 220 and 225 for the fourth and fifth frame data FD4 and FD5 are performed with a frequency of about 100 Hz, the host processor may provide the third and fourth frame data FD3 and FD4 to the display device 100 with a frame rate of about 100 Hz by increasing time lengths of the blank periods BP3 and BP4 of the third and fourth frame periods FP3 and FP4. In fifth and sixth frame periods FP5 and FP6, if renderings 230 and 235 for sixth and seventh frame data FD6 and FD7 are performed again with a frequency of about 144 Hz, the host processor may provide the fifth and sixth frame data FD5 and FD6 to the display device 100 again with a frame rate of about 144 Hz.

As described above, in the variable frame mode, each frame period FP1, FP2, FP3, FP4, FP5 and FP6 may include a constant active period AP1, AP2, AP3, AP4, AP5 and AP6 having a constant time length regardless of a variable frame rate, and a variable blank period BP1, BP2, BP3, BP4, BP5 and BP6 having a variable time length corresponding to the variable frame rate. For example, in the variable frame mode, the time length of the blank period BP1, BP2, BP3, BP4, BP5 and BP6 may increase as the frame rate decreases. In the variable frame mode, the controller 150 may receive the input image data DAT with the variable frame rate, and may output the output image data ODAT to the data driver 120 with the variable frame rate. Accordingly, the display device 100 supporting the variable frame mode may display (or refresh) an image in synchronization with the variable frame rate, thereby reducing or preventing a tearing phenomenon caused by a frame rate mismatch.

In the variable frame mode, since a time length of the blank period may be changed in each frame period, the time length of the blank period may be increased compared with a length of a blank period in a normal mode where an image is displayed with a constant frame rate, and the increased blank period may cause a leakage current, etc., which results in deterioration of luminance and deterioration of an image quality. To reduce or prevent the image quality deterioration caused by the leakage current in the variable blank period, the controller 150 according to example embodiments may change the gamma reference voltage VGMAR according to the frame rate. For example, if the time length of the blank period is increased since the frame rate is decreased, the controller 150 may control the power management circuit 140 to increase (an absolute value of) the gamma reference voltage VGMAR. In some example embodiments, the controller 150 may control the power management circuit 140 to increase the gamma reference voltage VGMAR to a desired voltage level by providing a voltage control signal VCS indicating the desired voltage level to the power management circuit 140. Accordingly, the deterioration of luminance caused by the increase of the blank period may be compensated by the increase of the gamma reference voltage VGMAR.

In order to check a current value of a variable frame rate, the controller 150 may check a period (or a duration of time) of a frame period in which a frame rate is changed at least until a blank period of the frame period in which the frame rate is changed ends. Further, in order to change the gamma reference voltage VGMAR corresponding to the checked current value of the variable frame rate, since the gamma reference voltage VGMAR cannot be changed during an active period, the gamma reference voltage VGMAR should be changed in a blank period of a frame period next to the frame period in which the frame rate is changed. Accordingly, in a method changing the gamma reference voltage VGMAR after checking the current value of the variable frame rate, a frame latency corresponding to at least two frame periods may exist from the change of the frame rate to the change of the gamma reference voltage VGMAR.

However, in the display device 100 according to example embodiments, the controller 150 may initialize the gamma reference voltage VGMAR if a blank period starts in a frame period including an active period and the blank period, and may change the gamma reference voltage VGMAR when duration of the blank period reaches at least one threshold time. Accordingly, in the variable frame mode where each frame period includes a constant active period having a constant time length regardless of a variable frame rate and a variable blank period having a variable time length corresponding to the variable frame rate, deterioration of luminance caused by an increase in time of the variable blank period may be reduced or prevented by the change of the gamma reference voltage VGMAR. Further, in some example embodiments, since the gamma reference voltage VGMAR may be initialized when the blank period starts in each frame period, and may be immediately changed when the time length of the blank period becomes the threshold time, the gamma reference voltage VGMAR may be changed, immediately at a blank period of a frame period in which a frame rate is changed, to a voltage level corresponding to the changed frame rate. Accordingly, the frame latency between the change of the frame rate and the change of the gamma reference voltage VGMAR may be reduced.

Hereinafter, an operation of the display device 100 according to example embodiments will be described below with reference to FIGS. 1, 3 and 4.

Figure 3:
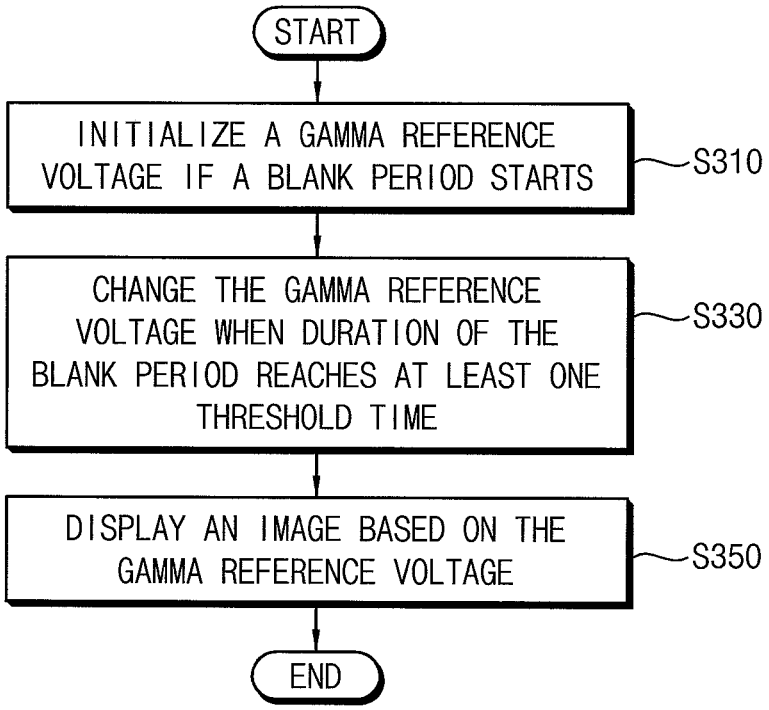
FIG. 3 is a flowchart illustrating a method of operating a display device according to example embodiments.
Figure 4:
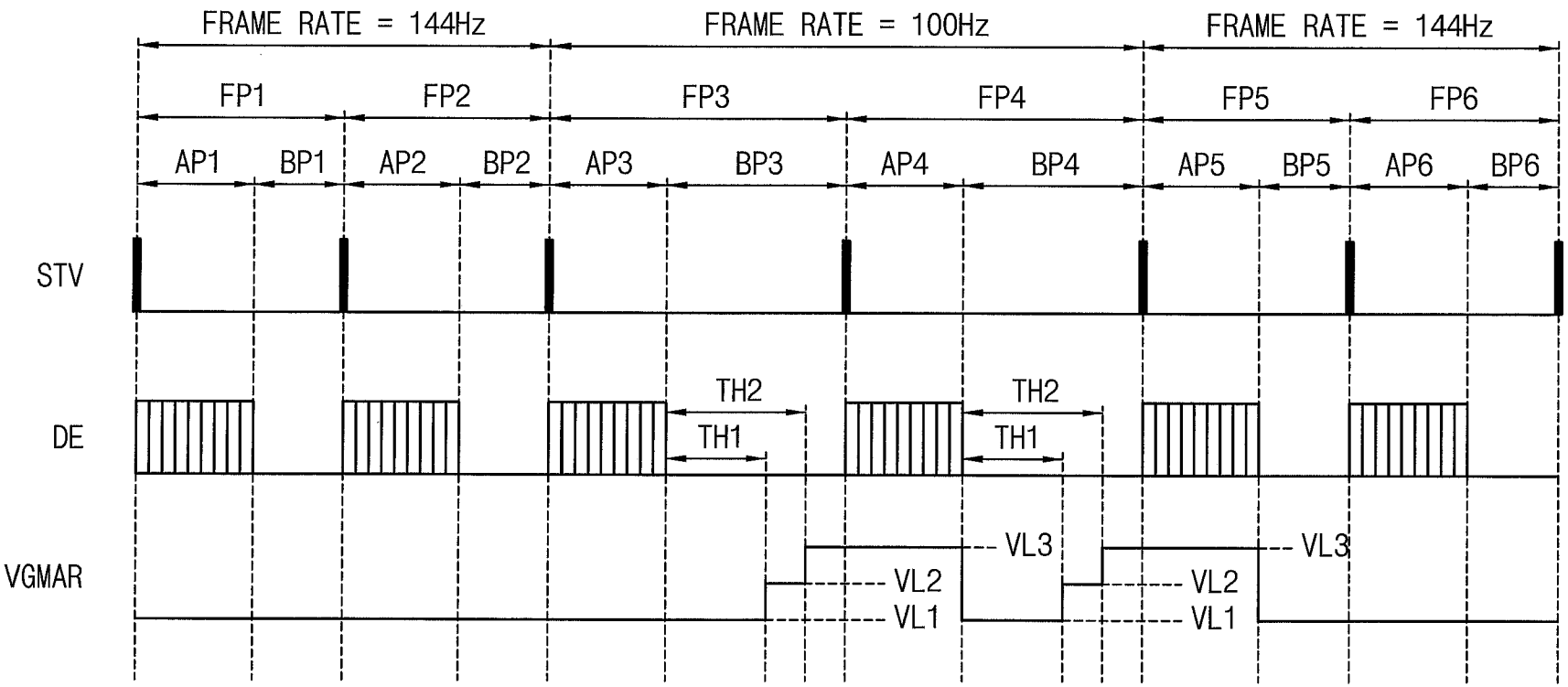
FIG. 4 is a timing diagram for describing an example when a gamma reference voltage is initialized and changed in a method illustrated in FIG. 3.

FIG. 3 is a flowchart illustrating a method of operating a display device according to example embodiments, and FIG. 4 is a timing diagram for describing an example when a gamma reference voltage is initialized and changed in a method illustrated in FIG. 3.

Referring to FIGS. 1, 3 and 4, a controller 150 of a display device 100 according to example embodiments may initialize a gamma reference voltage VGMAR if a blank period BP1, BP2, BP3, BP4, BP5 and BP6 starts in a frame period FP1, FP2, FP3, FP4, FP5 and FP6 including an active period AP1, AP2, AP3, AP4, AP5 and AP6 in which a data enable signal DE (e.g., an input data enable signal provided from a host processor to the controller 150, or an output data enable signal provided from the controller 150 to a data driver 120) toggles and the blank period BP1, BP2, BP3, BP4, BP5 and BP6 in which the data enable signal DE does not toggle (S310). The active period AP1, AP2, AP3, AP4, AP5 and AP6 may be a constant active period having a constant time length regardless of a variable frame rate, and the blank period BP1, BP2, BP3, BP4, BP5 and BP6 may be a variable blank period having a variable time length corresponding to the variable frame rate. For example, if the blank period BP1, BP2, BP3, BP4, BP5 and BP6 starts, the controller 150 may control a power management circuit 140 to initialize the gamma reference voltage VGMAR to a first voltage level VL1 by providing a voltage control signal VCS indicating the first voltage level VL1 to the power management circuit 140.

In some example embodiments, as illustrated in FIG. 4, the gamma reference voltage VGMAR may be initialized to the first voltage level VL1 at a start time point of the blank period BP1, BP2, BP3, BP4, BP5 and BP6 of each frame period FP1, FP2, FP3, FP4, FP5 and FP6. For example, at a start time point of a blank period BP4 of a fourth frame period FP4, the gamma reference voltage VGMAR may be initialized from a third voltage level VL3 to the first voltage level VL1. In other example embodiments, the gamma reference voltage VGMAR may be initialized within at least one threshold time TH1 from the start time point of the blank period BP1, BP2, BP3, BP4, BP5 and BP6 of each frame period FP1, FP2, FP3, FP4, FP5 and FP6. For example, the gamma reference voltage VGMAR may be initialized after a blank period (or a minimum blank period) corresponding to a maximum frame rate from the start time point of the blank period.

Further, in some example embodiments, the first voltage level VL1 of the initialized gamma reference voltage VGMAR may be a voltage level corresponding to the maximum frame rate in a variable frame rate range supported by the display device 100. For example, the display device 100 may support a variable frame rate range from about 25 Hz to about 144 Hz, and the first voltage level VL1 may be a voltage level having the smallest absolute value corresponding to the maximum frame rate of about 144 Hz. That is, the first voltage level VL1 may be a lowest voltage level corresponding to the maximum frame rate of about 144 Hz among a plurality of voltage levels of a positive gamma reference voltage VGMAR, and may be a highest voltage level corresponding to the maximum frame rate of about 144 Hz among a plurality of voltage levels of a negative gamma reference voltage VGMAR.

The controller 150 may change the gamma reference voltage VGMAR when duration of the blank period BP1, BP2, BP3, BP4, BP5 and BP6 reaches at least one threshold time TH1 and TH2 (S330). For example, when the duration of the blank period BP1, BP2, BP3, BP4, BP5 and BP6 reaches one threshold time TH1, the controller 150 may control the power management circuit 140 to change the gamma reference voltage VGMAR from the first voltage level VL1 corresponding to a first frame rate (e.g., the maximum frame rate) to a second voltage level VL2 corresponding to a second frame rate lower than the first frame rate by providing the voltage control signal VCS indicating the second voltage level VL2 to the power management circuit 140. In some example embodiments, the second voltage level VL2 corresponding to the second frame rate may have an absolute value greater than an absolute value of the first voltage level VL1 corresponding to the first frame rate. In other example embodiments, the second voltage level VL2 corresponding to the second frame rate may have an absolute value less than that of the first voltage level VL1 corresponding to the first frame rate.

In some example embodiments, the duration of each blank period BP1, BP2, BP3, BP4, BP5 and BP6 may be compared with a plurality of threshold times TH1 and TH2, and the (positive) gamma reference voltage VGMAR may be increased (or, in case of a negative gamma reference voltage, decreased) step by step each time the duration of each blank period BP1, BP2, BP3, BP4, BP5 and BP6 reaches each of the threshold times TH1 and TH2.

For example, as illustrated in FIG. 4, the at least one threshold time TH1 and TH2 may include a first threshold time TH1, and a second threshold time TH2 greater than the first threshold time TH1. If a frame rate is decreased from about 144 Hz to about 100 Hz in a third frame period FP3 of FIG. 4, a time length of a blank period BP3 of the third frame period FP3 may be increased. At a start time point of the blank period BP3 of the third frame period FP3, the gamma reference voltage VGMAR may be initialized to the first voltage level VL1 corresponding to the maximum frame rate. When duration of the blank period BP3 of the third frame period FP3 reaches the first threshold time TH1, the gamma reference voltage VGMAR may be increased from the first voltage level VL1 corresponding to the maximum frame rate to the second voltage level VL2 corresponding to a frame rate lower than the maximum frame rate. Further, when the duration of the blank period BP3 of the third frame period FP3 reaches the second threshold time TH2 greater than the first threshold time TH1, the gamma reference voltage VGMAR may be further increased from the second voltage level VL2 to a third voltage level VL3 corresponding to a further lower frame rate. As described above, each time the duration of the blank period BP3 reaches each of the first and second threshold times TH1 and TH2, the gamma reference voltage VGMAR may be increased step by step from the first voltage level VL1 to the second voltage level VL2, and then to the third voltage level VL3. Although FIG. 4 illustrates two threshold times TH1 and TH2 as the at least one threshold time, according to example embodiments, the at least one threshold time may include any suitable number of threshold times. For example, the at least one threshold time may include ten threshold times, and the gamma reference voltage VGMAR may be increased step by step from the first voltage level VL1 to ten voltage levels each time the duration of the blank period reaches each of the ten threshold times.

However, example embodiments may not be limited to this step-by-step increase of the positive gamma reference voltage VGMAR (or a step-by-step decrease of the negative gamma reference voltage VGMAR). For example, each time the duration of the blank period reaches each of the threshold times TH1 and TH2, the (positive) gamma reference voltage VGMAR may be increased or decreased to set or predetermined voltage levels that are determined according to frame rates respectively corresponding to the threshold times TH1 and TH2.

The display device 100 may display an image based on the gamma reference voltage VGMAR (S350). The data driver 120 may generate data voltages VD corresponding to image data ODAT provided from the controller 150 based on the gamma reference voltage VGMAR, and a plurality of pixels PX may display an image corresponding to the image data ODAT based on the data voltages VD.

In an example of FIG. 4, if each blank period BP1 and BP2 ends before the first threshold time TH1 in first and second frame periods FP1 and FP2 having a frame rate of about 144 Hz, an image may be displayed based on the gamma reference voltage VGMAR having the first voltage level VL1 during active periods AP2 and AP3 of second and third frame periods FP2 and FP3. If the frame rate is changed from about 144 Hz to about 100 Hz in the third frame period FP3, the gamma reference voltage VGMAR may be increased step by step from the first voltage level VL1 to the second voltage level VL2, and then to the third voltage level VL3 in the blank period BP3 of the third frame period FP3. Accordingly, in an active period AP4 of a fourth frame period FP4, an image may be displayed based on the gamma reference voltage VGMAR having the third voltage level VL3 corresponding to the frame rate of about 100 Hz. As described above, since, in the blank period BP3 of the third frame period FP3 in which the frame rate is changed, the gamma reference voltage VGMAR is changed to the third voltage level VL3 corresponding to the changed frame rate, a frame latency between a frame rate change and a gamma reference voltage change may be decreased (e.g., from a latency corresponding to at least two frame periods to a latency corresponding to one frame period).

Figure 5:
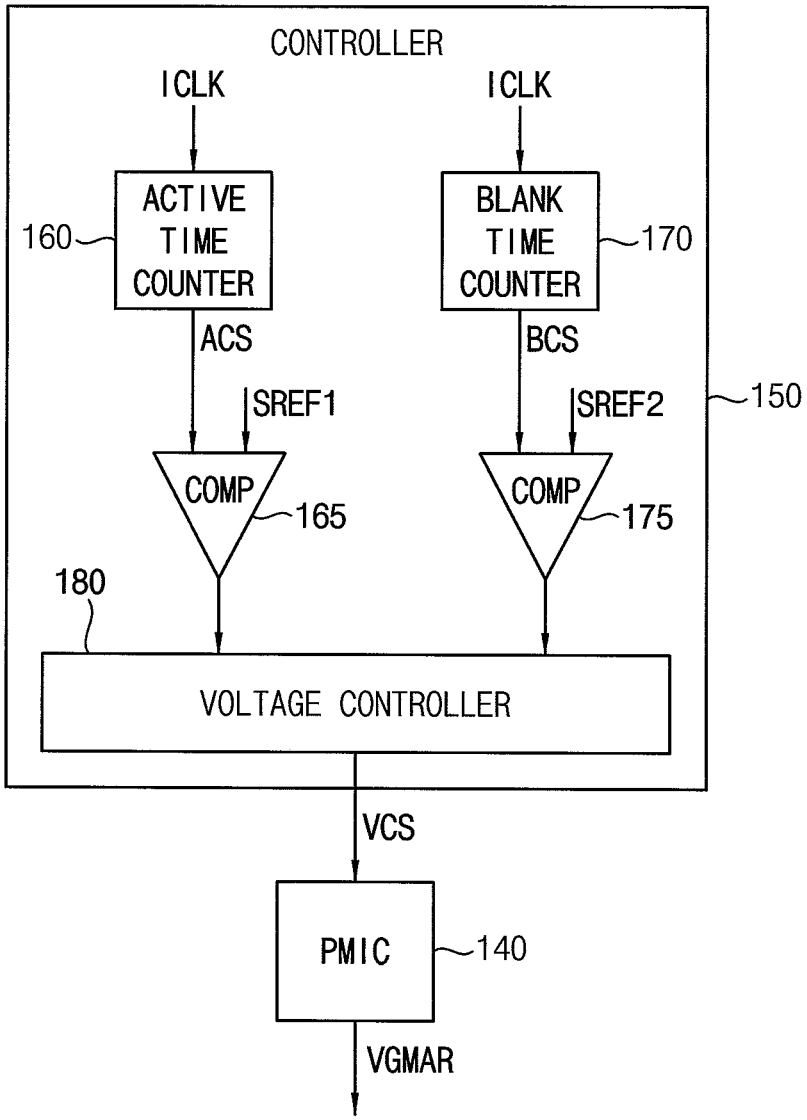
FIG. 5 is a block diagram illustrating a controller included in a display device according to example embodiments.

FIG. 5 is a block diagram illustrating a controller included in a display device according to example embodiments.

Referring to FIG. 5, a controller 150 may include an active time counter 160, a first comparator 165, a blank time counter 170, at least one second comparator 175 and a voltage controller 180.

The active time counter 160 may generate an active count signal ACS by counting an input clock signal ICLK during an active period of each frame period. In some example embodiments, the input clock signal ICLK may be a master clock signal included in a control signal CTRL provided from an external host processor, or may be a clock signal generated by an oscillator included in the controller 150.

The first comparator 165 may compare the active count signal ACS with a first reference signal SREF1 corresponding to a multiplication of the number of horizontal lines by the number of vertical lines. In some example embodiments, the number of horizontal lines may be a total horizontal line number that is a sum of the number of active horizontal lines and the number of blank horizontal lines, the number of vertical lines may be the number of active vertical lines, and the first reference signal SREF1 may correspond to a multiplication of the total horizontal line number by the number of active vertical lines. In this case, the first comparator 165 may output an output signal indicating that the active count signal ACS is equal to the first reference signal SREF1 immediately after the active period of each frame period, or at a start time point of a blank period of each frame period. In other example embodiments, the number of horizontal lines may be the total horizontal line number, the number of vertical lines may be a total vertical line number that is a sum of the number of the active vertical lines and the number of blank vertical lines, and the first reference signal SREF1 may correspond to a multiplication of the total horizontal line number by the total vertical line number. In this case, the first comparator 165 may output the output signal indicating that the active count signal ACS is equal to the first reference signal SREF1 after a minimum blank period corresponding to a maximum frame rate from the start time point of the blank period.

The voltage controller 180 may transfer a voltage control signal VCS indicating a first voltage level corresponding to the maximum frame rate to a power management circuit 140 when the output signal indicating that the active count signal ACS is greater than or equal to the first reference signal SREF1 is received from the first comparator 165, or when the active count signal ACS becomes greater than or equal to the first reference signal SREF1. In some example embodiments, the voltage controller 180 may transfer the voltage control signal VCS in a form of serial data (SDA) and a serial clock (SCL) of an inter-integrated circuit (I2C) interface to the power management circuit 140. The power management circuit 140 may initialize a gamma reference voltage VGMAR to the first voltage level corresponding to the maximum frame rate in response to the voltage control signal VCS indicating the first voltage level.

The blank time counter 170 may generate a blank count signal BCS by counting the input clock signal ICLK during the blank period of each frame period. The at least one second comparator 175 may compare the blank count signal BCS with at least one second reference signal SREF2 corresponding to at least one threshold time. In some example embodiments, if a data enable signal toggles before the blank count signal BCS becomes greater than or equal to the second reference signal SREF2, or if the next frame period starts before duration of the blank period reaches the at least one threshold time, the voltage controller 180 may reset the active time counter 160 and the blank time counter 170. Accordingly, in the next frame period, an image may be displayed based on the gamma reference voltage VGMAR having the first voltage level.

When the output signal indicating that the blank count signal BCS is greater than or equal to the second reference signal SREF2 is received from the second comparator 175, or when the blank count signal BCS becomes greater than or equal to the second reference signal SREF2, the voltage controller 180 may transfer the voltage control signal VCS indicating a second voltage level having an absolute value greater than that of the first voltage level to the power management circuit 140. The power management circuit 140 may change the gamma reference voltage VGMAR from the first voltage level corresponding to the maximum frame rate to the second voltage level corresponding to a frame rate lower than the maximum frame rate in response to the voltage control signal VCS indicating the second voltage level.

In some example embodiments, the controller 150 may include, as the at least one second comparator 175, a plurality of second comparators that compare the blank count signal BCS with a plurality of second reference signals SREF2 respectively corresponding to a plurality of different threshold times. In this case, the voltage controller 180 may provide the power management circuit 140 with the voltage control signal VCS indicating voltage levels that are increased step by step each time the blank count signal BCS becomes equal to each of the second reference signals SREF2, and the power management circuit 140 increase step by step the gamma reference voltage VGMAR in response to the voltage control signal VCS indicating the step-by-step increased voltage levels.

Figure 6:
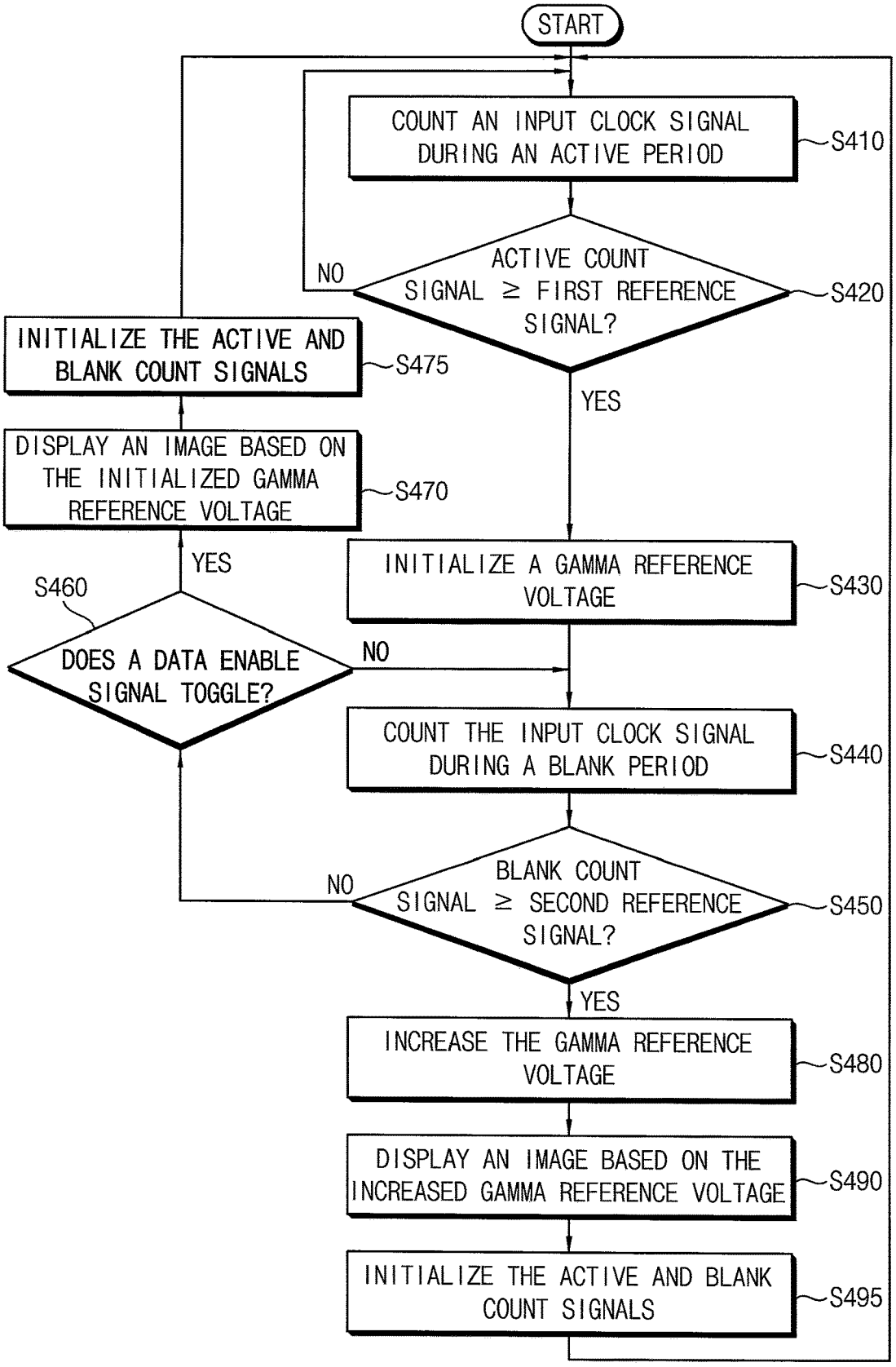
FIG. 6 is a flowchart illustrating a method of operating a display device according to example embodiments.

FIG. 6 is a flowchart illustrating a method of operating a display device according to example embodiments.

Referring to FIGS. 5 and 6, an active time counter 160 may generate an active count signal ACS by counting an input clock signal ICLK during an active period of each frame period (S410). The active time counter 160 may count the input clock signal ICLK until the active count signal ACS becomes equal to a first reference signal SREF1 corresponding to a multiplication of the number of horizontal lines by the number of vertical lines (S420).

If the active count signal ACS becomes greater than or equal to the first reference signal SREF1 (S420: YES), a voltage controller 180 may transfer a voltage control signal VCS indicating a first voltage level corresponding to the maximum frame rate to a power management circuit 140, and the power management circuit 140 may initialize a gamma reference voltage VGMAR to the first voltage level corresponding to the maximum frame rate in response to the voltage control signal VCS indicating the first voltage level (S430).

A blank time counter 170 may generate a blank count signal BCS by counting the input clock signal ICLK during a blank period of each frame period (S440). If a data enable signal toggles before the blank count signal BCS becomes greater than or equal to a second reference signal SREF2 (S450: NO and S460), or if the next frame period starts before duration of the blank period reaches a threshold time, an image may be displayed based on the initialized gamma reference voltage VGMAR, or the gamma reference voltage VGMAR having the first voltage level (S470), and the voltage controller 180 may initialize the active count signal ACS and the blank count signal BCS by resetting the active time counter 160 and the blank time counter 170 (S475).

If the blank count signal BCS becomes greater than or equal to the second reference signal SREF2 (S450: YES), the voltage controller 180 may transfer the voltage control signal VCS indicating a second voltage level having an absolute value greater than that of the first voltage level to the power management circuit 140, and the power management circuit 140 may increase the gamma reference voltage VGMAR from the first voltage level corresponding to the maximum frame rate to the second voltage level corresponding to a frame rate lower than the maximum frame rate in response to the voltage control signal VCS indicating the second voltage level (S480). In some example embodiments, the blank count signal BCS may be compared with a plurality of second reference signals SREF2 corresponding to a plurality of threshold times, and the gamma reference voltage VGMAR may be increased step by step each time the blank count signal BCS becomes equal to each of the second reference signals SREF2. If the gamma reference voltage VGMAR is increased (S480), an image may be displayed based on the increased gamma reference voltage VGMAR, or the gamma reference voltage VGMAR having the second voltage level (S490), and the voltage controller 180 may initialize the active count signal ACS and the blank count signal BCS by resetting the active time counter 160 and the blank time counter 170 (S495).

Figure 7A:
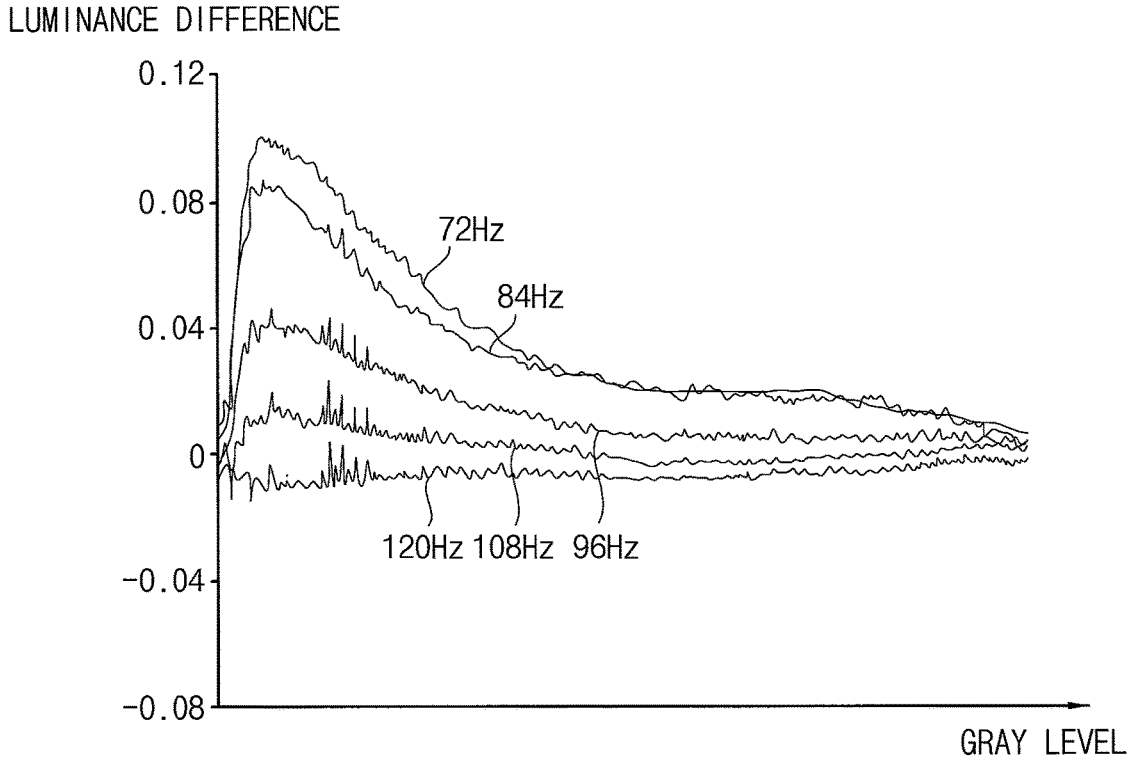
FIG. 7A is a graph illustrating a luminance difference according to a gray level at respective frame rates in a case where a gamma reference voltage is neither initialized nor changed in a variable frame mode.
Figure 7B:
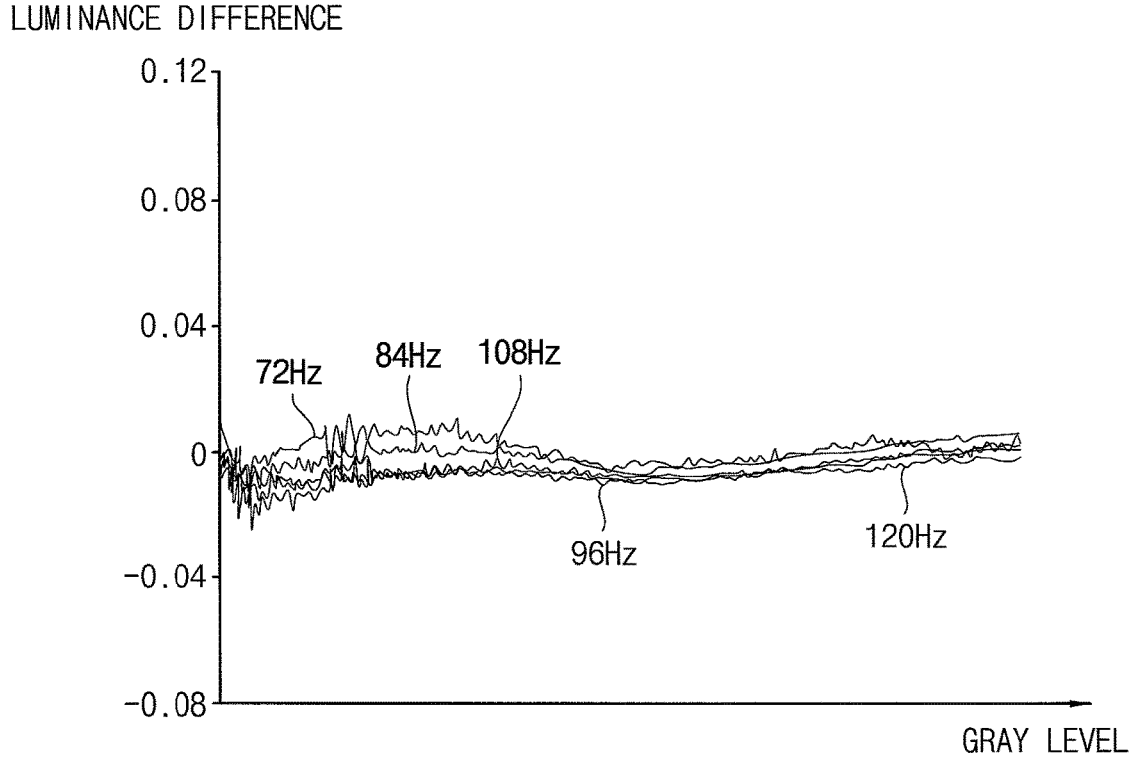
FIG. 7B is a graph illustrating a luminance difference according to a gray level at respective frame rates in a case where a gamma reference voltage is initialized and changed in a variable frame mode according to example embodiments.

FIG. 7A is a graph illustrating a luminance difference according to a gray level at respective frame rates in a case where a gamma reference voltage is neither initialized nor changed in a variable frame mode, and FIG. 7B is a graph illustrating a luminance difference according to a gray level at respective frame rates in a case where a gamma reference voltage is initialized and changed in a variable frame mode according to example embodiments.

In FIGS. 7A and 7B, an X axis represents a gray level, and an Y axis represents a value calculated by dividing a luminance difference between luminance at a maximum frame rate (e.g., about 144 Hz) and luminance at respective changed frame rates (e.g., about 120 Hz, about 108 HZ, about 96 Hz, about 84 Hz and about 72 Hz) by the luminance at the maximum frame rate.

FIG. 7A represents the luminance difference according to the gray level in a case where a gamma reference voltage is not changed when a frame rate is changed from the maximum frame rate of about 144 Hz to respective frame rates of about 120 Hz, about 108 HZ, about 96 Hz, about 84 Hz and about 72 Hz. As illustrated in FIG. 7A, if the gamma reference voltage is not changed when the frame rate is changed, luminance may be decreased by about 10% compared with the luminance at the maximum frame rate.

FIG. 7B represents the luminance difference according to the gray level in a case where the gamma reference voltage is initialized and changed according to example embodiments when the frame rate is changed from the maximum frame rate of about 144 Hz to the respective frame rates of about 120 Hz, about 108 HZ, about 96 Hz, about 84 Hz and about 72 Hz. As illustrated in FIG. 7B, if the gamma reference voltage is initialized and changed, the luminance may be increased or decreased only by about 1.4% compared with the luminance at the maximum frame rate even if when the frame rate is changed. Accordingly, in a display device according to example embodiments, deterioration of luminance caused by a frame rate change may be reduced or prevented.

Figure 8:
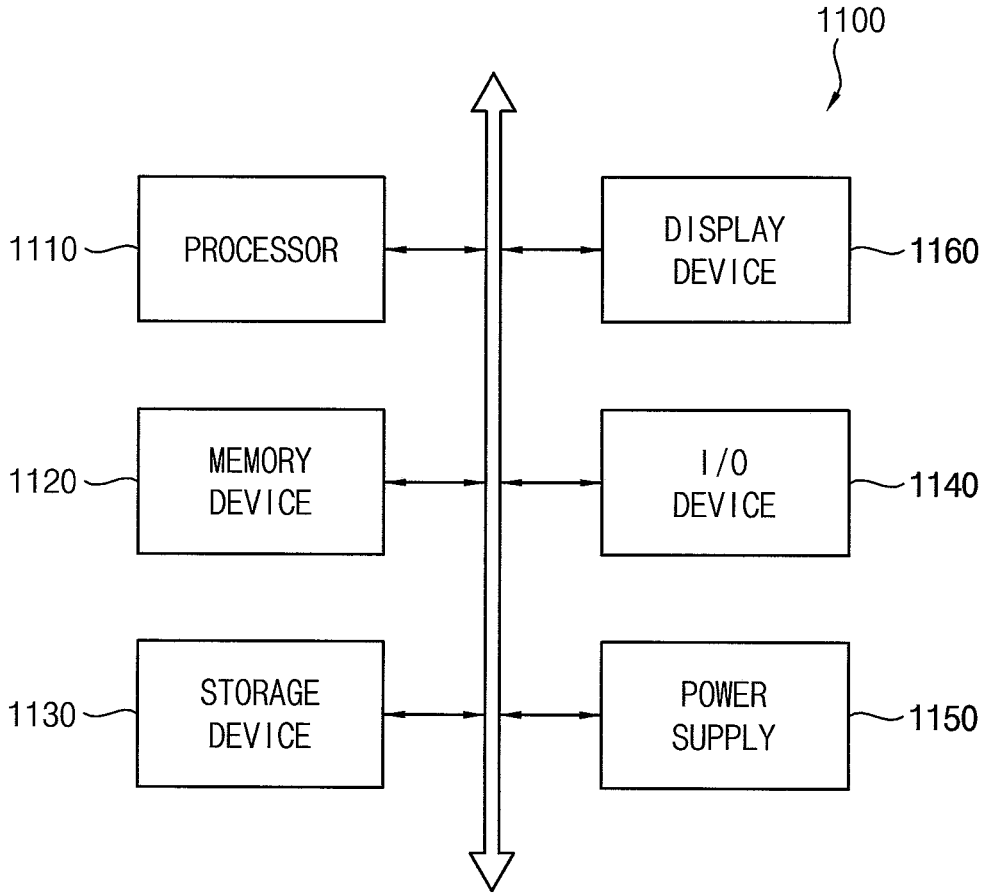
FIG. 8 is a block diagram illustrating an electronic device including a display device according to example embodiments.

FIG. 8 is a block diagram illustrating an electronic device including a display device according to example embodiments.

Referring to FIG. 8, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

The display device 1160 may initialize a gamma reference voltage if a blank period starts in each frame period, and may change the gamma reference voltage when duration of the blank period reaches at least one threshold time. Accordingly, deterioration of luminance caused by an increase in time of a variable blank period in a variable frame mode may be reduced or prevented. Further, when a frame rate is changed, the gamma reference voltage may be changed to a voltage level corresponding to the changed frame rate in (a blank period of) the same frame period at which the frame rate is changed, and thus a frame latency between a frame rate change and a gamma reference voltage change may be reduced.

The inventive concepts may be applied to any display device supporting the variable frame mode, and any electronic device including the display device. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A display device comprising:

a display panel comprising a plurality of pixels;

a data driver configured to generate data voltages based on a gamma reference voltage, and to provide the data voltages to the plurality of pixels;

a gate driver configured to provide gate signals to the plurality of pixels; and a controller configured to control the data driver and the gate driver, wherein the controller is configured to initialize the gamma reference voltage when a blank period starts in a frame period comprising an active period and the blank period, and to change the gamma reference voltage when a duration of the blank period reaches at least one threshold time.

2. The display device of claim 1, wherein the active period has a constant time length, and the blank period has a variable time length.

3. The display device of claim 1, wherein the controller is configured to initialize the gamma reference voltage at a start time point of the blank period of the frame period.

4. The display device of claim 1, wherein the controller is configured to initialize the gamma reference voltage before the at least one threshold time from a start time point of the blank period of the frame period.

5. The display device of claim 1, wherein the controller is configured to initialize the gamma reference voltage at a voltage level corresponding to a maximum frame rate in a variable frame rate range supported by the display device.

6. The display device of claim 1, wherein the controller is configured to change the gamma reference voltage from a first voltage level corresponding to a first frame rate to a second voltage level corresponding to a second frame rate lower than the first frame rate when the duration of the blank period reaches the at least one threshold time.

7. The display device of claim 6, wherein an absolute value of the second voltage level is greater than an absolute value of the first voltage level.

8. The display device of claim 1, wherein the at least one threshold time comprises a first threshold time and a second threshold time greater than the first threshold time, wherein the controller is configured to change the gamma reference voltage from a first voltage level to a second voltage level having an absolute value greater than that of the first voltage level when the duration of the blank period reaches the first threshold time, and wherein the controller is configured to change the gamma reference voltage from the second voltage level to a third voltage level having an absolute value greater than that of the second voltage level when the duration of the blank period reaches the second threshold time.

9. The display device of claim 1, further comprising:

a power management circuit configured to generate the gamma reference voltage, wherein the controller is configured to control the power management circuit to initialize the gamma reference voltage to a first voltage level by providing a voltage control signal indicating the first voltage level to the power management circuit when the blank period starts, and wherein the controller is configured to control the power management circuit to change the gamma reference voltage from the first voltage level to a second voltage level by providing the voltage control signal indicating the second voltage level having an absolute value greater than that of the first voltage level to the power management circuit when the duration of the blank period reaches the at least one threshold time.

10. The display device of claim 1, wherein the controller comprises:

an active time counter configured to generate an active count signal by counting an input clock signal during the active period;

a first comparator configured to compare the active count signal with a first reference signal corresponding to a multiplication of a number of horizontal lines by a number of vertical lines;

a blank time counter configured to generate a blank count signal by counting the input clock signal during the blank period;

at least one second comparator configured to compare the blank count signal with at least one second reference signal corresponding to the at least one threshold time; and a voltage controller configured to transfer a voltage control signal indicating a first voltage level to a power management circuit included in the display device when the active count signal becomes greater than or equal to the first reference signal, and to transfer the voltage control signal indicating a second voltage level having an absolute value greater than that of the first voltage level to the power management circuit when the blank count signal becomes greater than or equal to the second reference signal.

11. The display device of claim 10, wherein the voltage controller is configured to reset the active time counter and the blank time counter when a data enable signal toggles before the blank count signal becomes greater than or equal to the second reference signal.

12. The display device of claim 10, wherein the at least one second comparator comprises a plurality of second comparators configured to compare the blank count signal with a plurality of second reference signals respectively corresponding to a plurality of different threshold times.

13. The display device of claim 10, wherein the voltage controller is configured to transfer the voltage control signal to the power management circuit through an inter-integrated circuit (I2C) interface.

14. A method of operating a display device, the method comprising:

initializing a gamma reference voltage when a blank period starts in a frame period comprising an active period and the blank period;

changing the gamma reference voltage when duration of the blank period reaches at least one threshold time; and displaying an image based on the gamma reference voltage.

15. The method of claim 14, wherein the initializing of the gamma reference voltage when the blank period starts comprises:

initializing the gamma reference voltage to a voltage level corresponding to a maximum frame rate in a variable frame rate range supported by the display device at a start time point of the blank period of the frame period.

16. The method of claim 14, wherein the changing of the gamma reference voltage when the duration of the blank period reaches the at least one threshold time comprises:

changing the gamma reference voltage from a first voltage level corresponding to a first frame rate to a second voltage level corresponding to a second frame rate lower than the first frame rate when the duration of the blank period reaches the at least one threshold time.

17. The method of claim 14, wherein the at least one threshold time comprises a first threshold time and a second threshold time greater than the first threshold time, and wherein the changing of the gamma reference voltage when the duration of the blank period reaches the at least one threshold time comprises:

changing the gamma reference voltage from a first voltage level to a second voltage level having an absolute value greater than that of the first voltage level when the duration of the blank period reaches the first threshold time; and changing the gamma reference voltage from the second voltage level to a third voltage level having an absolute value greater than that of the second voltage level when the duration of the blank period reaches the second threshold time.

18. The method of claim 14, wherein the initializing of the gamma reference voltage when the blank period starts comprises:

generating an active count signal by counting an input clock signal during the active period;

comparing the active count signal with a first reference signal corresponding to a multiplication of a number of horizontal lines by a number of vertical lines; and initializing the gamma reference voltage when the active count signal becomes greater than or equal to the first reference signal.

19. The method of claim 18, wherein the changing of the gamma reference voltage when the duration of the blank period reaches the at least one threshold time comprises:

generating a blank count signal by counting the input clock signal during the blank period;

comparing the blank count signal with at least one second reference signal corresponding to the at least one threshold time; and changing the gamma reference voltage when the blank count signal becomes greater than or equal to the second reference signal.

20. The method of claim 19, further comprising:

initializing the active count signal and the blank count signal when a data enable signal toggles before the blank count signal becomes greater than or equal to the second reference signal.

* * * * *